United States Patent [19]

Goodman

[11] Patent Number: 4,599,753

[45] Date of Patent: Jul. 15, 1986

[54] ASSEMBLY FOR UTILIZING BILGE PUMP AS POWER WATER JET

[76] Inventor: Steven Goodman, 85 Oak St., Norwood, N.J. 07648

[21] Appl. No.: 764,487

[22] Filed: Aug. 12, 1985

[51] Int. Cl.[4] ..... E04H 3/18; A47K 3/00

[52] U.S. Cl. ..... 4/559; 4/541; 4/542; 4/496; 4/503; 4/509; 4/567; 4/492; 4/488; 220/85 R

[58] Field of Search ..... 4/488, 487, 490, 496, 4/503, 504, 541, 542, 506, 508, 509, 511, 546, 559, 567, 584, 592, 593, 538, 492, 544; 220/85 R; 248/247; 128/66; 210/169

[56] References Cited

U.S. PATENT DOCUMENTS

| | | | |
|---|---|---|---|
| 1,900,783 | 3/1933 | Weiss | 220/85 R |
| 2,100,186 | 11/1937 | Hagopian | 4/569 |
| 3,631,544 | 1/1972 | Tytel | 4/506 |
| 3,675,814 | 7/1972 | Graf | 220/85 R |
| 4,420,846 | 12/1983 | Bonner | 4/542 |
| 4,439,876 | 4/1984 | Chalberg | 4/542 |

*Primary Examiner*—Henry K. Artis
*Attorney, Agent, or Firm*—Peter L. Berger

[57] ABSTRACT

A submersible bilge pump is used within a tub to provide a Jacuzzi-type jet spray. A mounting assembly enables the bilge pump to be located below the water in the tub, yet the mounting assembly allows for effective mounting to the tub to provide the water jet type action. The mounting assembly also allows for the submersible bilge pump to be rotatably fastened to the tub to provide a whirlpool type action when desired.

5 Claims, 6 Drawing Figures

ASSEMBLY FOR UTILIZING BILGE PUMP AS POWER WATER JET

BACKGROUND OF THE INVENTION

This invention relates to the conversion of standard tubs, whether portable or fixed to serve as whirlpool or Jacuzzi-type tubs.

Conventionally, Jacuzzi or whirlpool-type tubs are very expensive and require special construction. Special plumbing fixtures are required, and the entire assembly and costs diminishes the utilization of these type tubs.

An object of this invention is to provide an apparatus which converts ordinary portable, inflatable or fixed tubs to Jacuzzi or whirlpool type systems without requiring special plumbing.

Another object of this invention is to provide such a mounting system which is able to quickly and effectively be attached to conventional tubs.

Yet another object of this invention is to provide such an assembly which utilizes a battery driven submersible bilge pump, with the battery being of substantially low voltage so as to eliminate possibilities of shock or injury.

Still another object of this invention is to provide such an assembly which is adaptable to be attached to either conventional tubs as found in bathtubs or circular inflatable tubs which are generally used outdoors.

Yet another object of this invention is to provide such an assembly which enables the height of the bilge pump to be adjusted in the water so as to control the effect of the jet action.

Another object of this invention is to provide such an assembly in which the direction of the jet spray is adjusted so as to provide either a whirlpool or Jacuzzi-type arrangement.

Other objects, advantages and features of this invention will become more apparent from the following description.

SUMMARY OF THE INVENTION

In accordance with the principles of this invention, the above objects are accomplished by providing a mounting means for utilizing a submersible bilge pump in a tub of water, the mounting means comprising carrier means for carrying the bilge pump, the bilge pump having a spout and being attached to the carrier means permitting vertical positioning of the bilge pump at a desired level in the water, further comprising a reducer attached to the spout of the bilge pump to enhance the jet force emanating from the bilge pump. In one specific embodiment, the bilge pump is attached to a channel which terminates in upper and lower flanges. This type of assembly is especially adapted to be used in a tub which has upper and lower bands secured within the inner wall of the tub. The channel is flexible and is able to be flexed so as to allow the flanges to slip under the bands. When the channel is released, it will be fixedly held beneath the bands because of the flanges being slipped under the bands. A bracket is employed for attaching the bilge pump to the channel, and a slot is provided in the channel for this assembly. The bilge pump is battery driven, and a small electric battery is provided to allow the bilge pump to effectively and safely operate within the tub. A plurality of bilge pumps may be placed around the tub so as to provide a plurality of jet sprays.

As may be realized the conversion of a tub to a Jacuzzi is accomplished without the necesssity of special plumbing, and the use of the simple-battery driven submersible bilge pump allows a safe and effective conversion to be accomplished.

In another embodiment of this invention, the bilge pump maybe housed within a C clamp which also has a housing. The C clamp is attached to the wall of a standard tub, and the pump is mounted to sit within the water so as to allow the bilge pump to be carried in the water. The bilge pump is rotatably mounted to the housing, so as to allow the water to either be directed along the wall of the tub to form a whirlpool-type action or perpendicular thereto to provide a Jacuzzi-type action. The C-clamp is provided with vertical slots for allowing the height of the entire assembly to be adjusted with respect to the wall of the tub. Additionally, the housing includes a compartment in which a small battery may be carried so as to allow the bilge pump to be easily connected to the battery and drive the pump.

DETAILED DESCRIPTION

Figure 1:
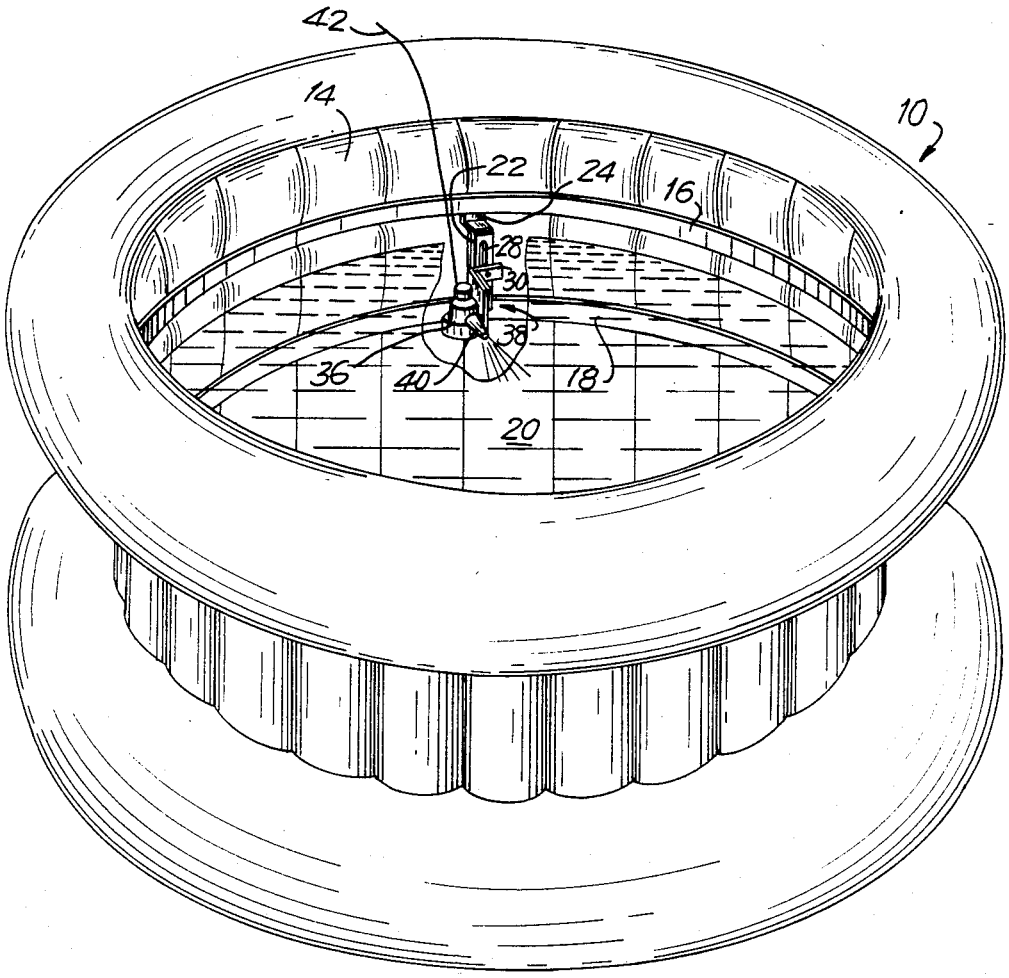
FIG. 1 is a perspective view showing a circular inflatable type tub with a plurality of jets attached to the mounting means of this invention.
Figure 3:
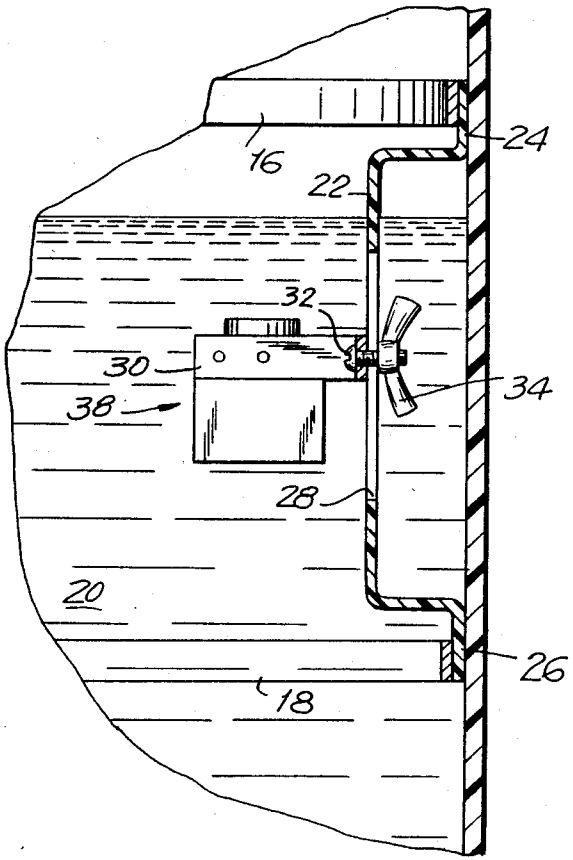
FIG. 3 is a sectional view along the wall of the circular tub showing the mounting means of this invention attached thereto.

FIG. 1 is a perspective view of a circular tub 10 which may be of an inflatable type. There is shown a plurality of water jets 12 attached to the inner wall 14 of the tub. Upper and lower spaced apart bands 16 and 18 are attached to the inner wall of the tub. The tub will be filled with water 20 to an appropriate depth.

Figure 2:
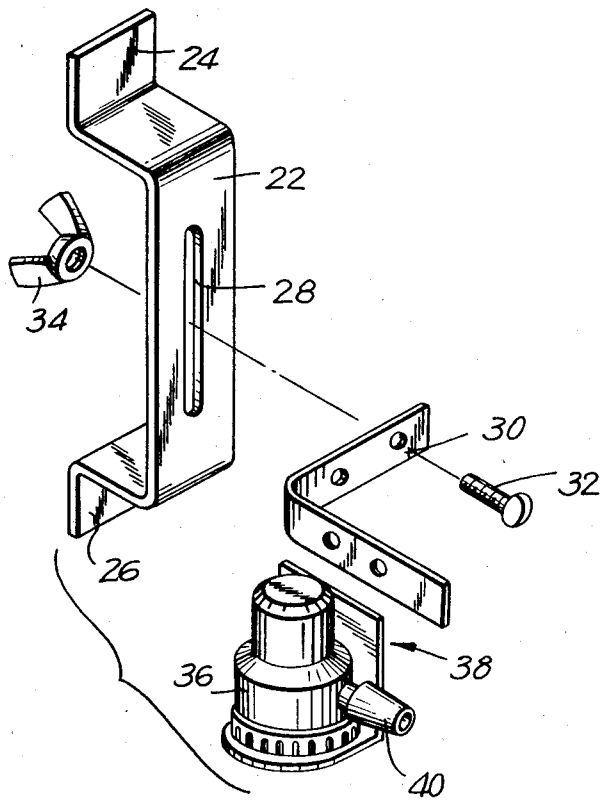
FIG. 2 is an exploded perspective view of one embodiment of this invention for use in the tub illustrated in FIG. 1.

FIG. 2 is an exploded perspective view of one embodiment of a mounting means for using the submersible pump to convert a tub of a Jacuzzi-type tub. There is shown a channel 22 terminating in upper and lower flanges 24 and 26, the channel having a vertical slot 28 to which there is attached a bracket 30 by means of a screw 32 and wing-bolt 34. A submersible bilge pump 36 is attached to the bracket 30 as at 38, and a reducer 40 is attached to the spout end of the bilge pump to enhance the jet flow emanating therefrom. The channel 22 is made of plastic, and the bands 16 and 18 of the tub are able to accommodate flanges 24 and 26, respectively, thereunder. This is accomplished by flexing channel 22 to slide the flanges 24 and 26 under bands 16 and 18, respectively, and when the channel is released, it will be firmly held between the bands. Additionally, the location of the channel under the bands can be adjusted by merely sliding the channel thereunder.

The bilge pump is operated by a battery-driven motor, and the battery-driven motor is a low DC voltage-type motor. An insulated wire 42 is attached to the pump and is carried outside of the tub to be attached to the portable battery located there. In this manner, the bilge pump can easily function as a power jet without requiring special plumping. As may be readily understood, the position of the bilge motor with respect to the tub can be adjusted by sliding the channel under the bands and by raising or lowering the submersible pump as by adjusting bracket 30 in longitudinal slot 28.

Figure 4:
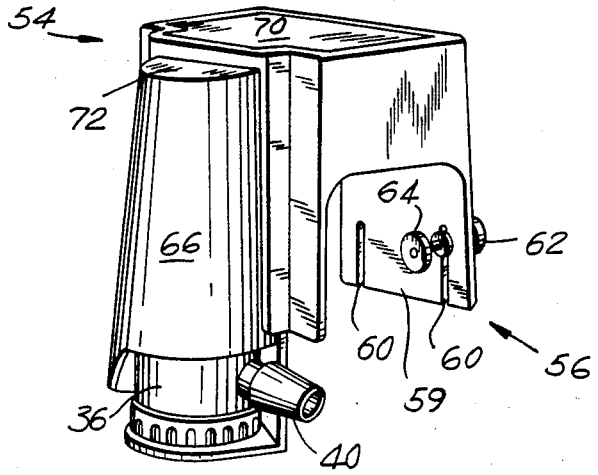
FIG. 4 is a perspective view showing a second embodiment of this invention attached to a standard tub of a bathroom.
Figure 5:
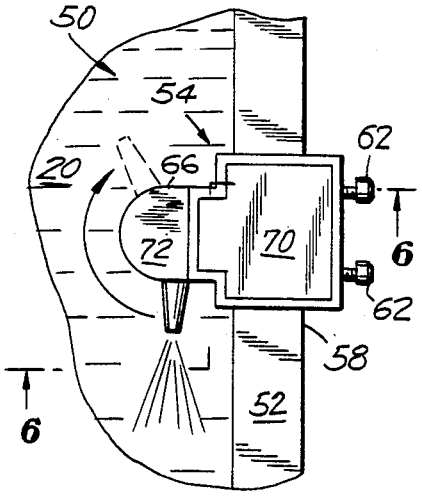
FIG. 5 is a top view showing the second embodiment attached to the wall of the tub.
Figure 6:
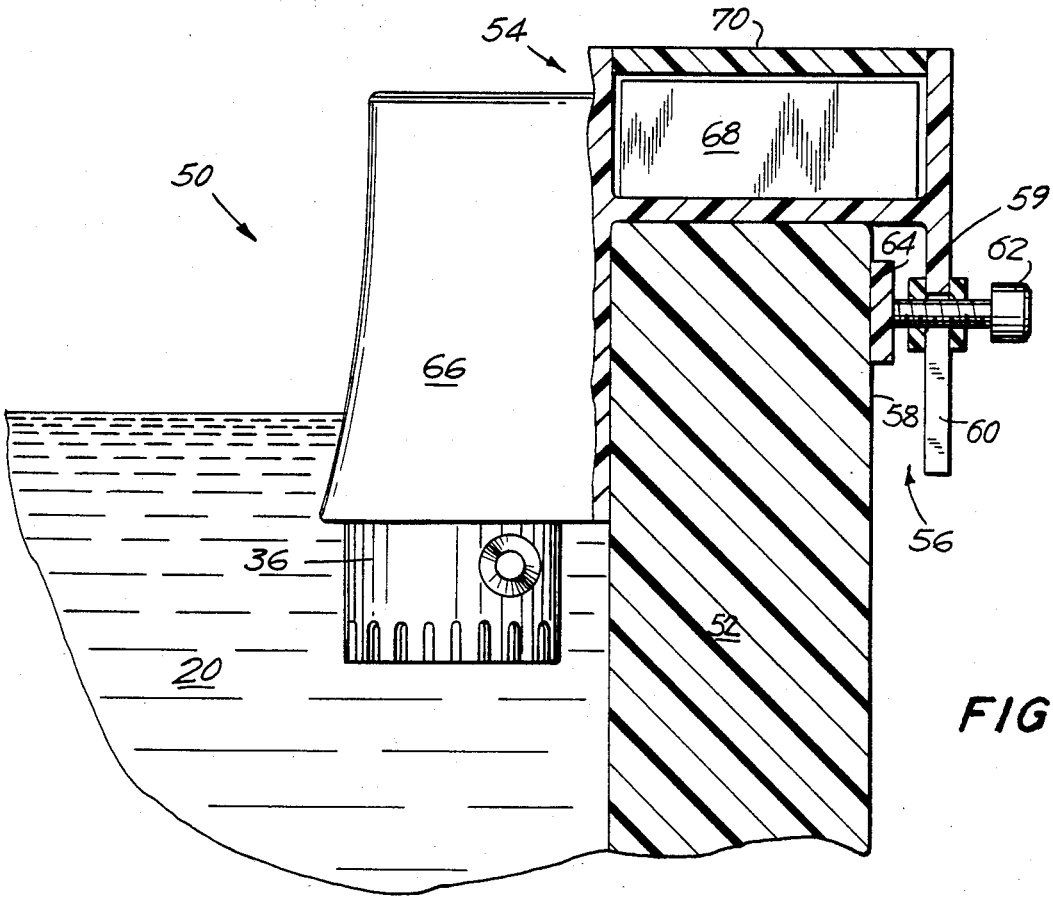
FIG. 6 is a sectional view taken along the lines 6—6 of FIG. 5 showing the attachment of the submersible bilge pump to the tub.

FIG. 4 is a perspective view of another embodiment of this invention showing a more conventional tub 50 having a wall 52 to which the carrier 54 is attached. The carrier is formed as a C clamp 56 with one leg of the C clamp attached to the outer surface 58 of the tub. A pair of vertical slots 60 are provided in outer leg 58, and a pair of threaded members 62 are provided having a head 64 for bearing against the outer wall 58 of the tub. In this manner, the entire carrier can be moved upwardly or downwardly with respect to the wall of the tub so as to adjust the vertical position of the bilge pump 36 in the water.

The other leg of the C clamp is formed of a housing 66 in which the bilge pump is located, and the spout and reducer 42 is pivotably and rotatably attached within the housing 66 as at 72. A battery compartment 68 is integrally formed in the carrier, and a lid or cover 70 enables the battery compartment to be effectively sealed. The connection between the bilge pump and battery may be maintained internal to the carrier 54.

The carrier 54 is formed of a plastic type material, and the submersible bilge pump 36 can generate sufficient power to provide a very powerful jet, especially with the reducer to provide an efficient and effective whirlpool-type arrangement.

As may be readily understood, this invention provides the means to convert standard tubs into whirlpools or Jacuzzis, without the addition of expensive plumping. Further, the submersible bilge pump is battery driven, and the low voltage DC battery provides for safe operation. Additionally, due to the portablility of the carriers for the submersible bilge pumps, the location and positioning of the bilge pumps may be readily changed as to suit the users purposes, and there is no fixed plumbing or electrical installation which is required to be able to use applicant's novel invention.

The above invention has been described with several embodiments. Numerous changes and modifications from this invention may be made without departing from the spirit and teaching of this invention.

What is claimed is:

1. Mounting means for utilizing a submersible bilge pump is a curved tub of water to function as a water jet, said curved tub having an inner wall, said mounting means comprising carrier means for carrying said bilge pump, a band disposed circumferentially inside said tube against said inner wall to which said carrier is attached, said carrier being movable with respect to said band in a circumferential direction to adjust the circumferential position of said bilge pump, said bilge pump having a spout end being attached to said carrier means, said bilge pump being attached to said carrier means permitting vertical positioning of said bilge pump at a desired level in the water.

2. Mounting means as claimed in claim 1, wherein said carrier means comprises a flexible channel terminating in upper and lower flanges, said tub comprising a pair of said bands spaced-apart and circumferentially disposed against the inner wall, said flexible channel being arched to draw said flanges towards each other and be placed underneath said bands, said channel being released to retain said channel under said bands and permit said carrier to slide thereunder, said channel further comprising a vertical slot in a center portion thereof the which said bilge pump is vertically adjustably connected.

3. Mounting means as claimed in claim 2, further comprising a bracket attached to said slot of said channel and to said bilge pump.

4. Mounting means as claimed in claim 3, wherein said bilge pump is driven by a battery driven electric motor.

5. Mounting means as claimed in claim 4, further comprising a plurality of said bilge pumps mounted to said tub to provide jets of water perpendicular to the wall of said tub to form a Jacuzzi style tub.

* * * * *